United States Patent [19]

Brandt et al.

[11] Patent Number: 4,857,108

[45] Date of Patent: Aug. 15, 1989

[54] CEMENTED CARBONITRIDE ALLOY WITH IMPROVED PLASTIC DEFORMATION RESISTANCE

[75] Inventors: Nils G. L. Brandt, Solna; Ake B. Byhlin, Bandhagen, both of Sweden

[73] Assignee: Sandvik AB, Sandviken, Sweden

[21] Appl. No.: 121,797

[22] Filed: Nov. 17, 1987

[30] Foreign Application Priority Data

Nov. 20, 1986 [SE] Sweden ..... 8604971
Dec. 22, 1986 [SE] Sweden ..... 8605519

[51] Int. Cl.[4] ..... C22C 29/04
[52] U.S. Cl. ..... 75/238; 419/13
[58] Field of Search ..... 75/238; 419/13

[56] References Cited

U.S. PATENT DOCUMENTS

| | | | |
|---|---|---|---|
| 4,065,301 | 12/1977 | Tanaka et al. | 419/13 |
| 4,150,984 | 4/1979 | Tanaka et al. | 75/238 |
| 4,342,594 | 8/1982 | Ettmayer et al. | 75/238 |
| 4,514,224 | 4/1985 | Nishigaki | 75/238 |
| 4,521,248 | 6/1985 | Yamamoto et al. | 75/238 |
| 4,563,215 | 1/1986 | Yamamoto et al. | 75/238 |
| 4,636,252 | 1/1987 | Yoshimura et al. | 75/238 |
| 4,639,352 | 1/1987 | Kodana et al. | 75/238 |

FOREIGN PATENT DOCUMENTS

| | | | |
|---|---|---|---|
| 60-92445 | 5/1985 | Japan | 75/238 |
| 61-195950 | 8/1986 | Japan | 75/238 |
| 61-10150 | 9/1986 | Japan | 75/238 |
| 61-201750 | 9/1986 | Japan | 75/238 |
| 62-170452 | 7/1987 | Japan | 75/238 |

*Primary Examiner*—Stephen J. Lechert, Jr.
*Assistant Examiner*—Eric Jorgensen
*Attorney, Agent, or Firm*—Burns, Doane, Swecker & Mathis

[57] ABSTRACT

The present invention relates to an alloy for cutting tools comprising 75–97% by weight of a hard carbonitride component and 3–25% by weight of a binder metal, the hard component comprising titanium as the main metallic component besides tungsten, molybdenum, tantalum and optionally vanadium and as non metallic components carbon and nitrogen. The binder metal is selected from the group consisting of iron, cobalt and nickel.

The plastic deformation resistance of the alloy has been improved by adding tantalum as a mixed carbide (Ti,-Ta)C possibly also including Nb.

12 Claims, 1 Drawing Sheet

CEMENTED CARBONITRIDE ALLOY WITH IMPROVED PLASTIC DEFORMATION RESISTANCE

The present invention relates to a cemented carbonitride alloy containing titanium as the main component with improved resistance to plastic deformation and wear.

Alloys based on titanium carbide have been used for finishing of steels but have only found limited applicability because of limitations in several important properties. The strength and toughness of TiC-based cutting tools are generally much lower than for WC-based tools thus limiting the use of TiC-based tools in applications with higher feed rates and/or interrupted cutting. The resistance to plastic deformation is also generally poor which seriously limits the use at higher cutting speeds and feeds. TiC-based tools also have a very low thermal conductivity, much lower than WC-based tools, and consequently thermal cracking is a serious problem.

To some extent these problems have been overcome with TiN as an alloying additive. TiN reduces grain size which improves strength and toughness. TiN also increases the thermal conductivity of the tool and consequently the resistance against thermal cracking is improved. The resistance against plastic deformation is also improved for several reasons of which one is increased alloying (solid solution hardening) of the binder phase. However, the lack of adequate plastic deformation resistance is still a major problem for many applications.

U.S. Pat. No. 3,971,656 discloses a sintered carbonitride alloy in which the carbonitride is a two phase mixture consisting of a titanium and nitrogen rich core surrounded by a phase rich in group VI metals and poor in nitrogen. U.S. Pat. No. 4,120,719 discloses a cemented carbonitride alloy in which tantalum is added as a nitride or carbonitride which results in a structure in which tantalum is in contact with the binder phase. DE No. 34 18 403 teaches a carbonitride alloy with a structure consisting of a hard phase with a TiC-core surrounded by a solution of at least one of TaC, NbC, ZrC, WC, TiC and/or TiN, a TiN-phase and a binder phase of Co and/or Ni. JP No. 57-169058 discloses a sintered hard alloy containing >95 vol-% of a hard phase consisting of TiC(and/or TiN), TaC(and/or NbC) and WC(and/or $Mo_2C$) and <5 vol% of an iron group binder metal.

An object of the present invention is to provide a cemented carbonitride with improved properties related to the above mentioned disadvantages and especially with respect to resistance against plastic deformation.

According to this invention there is provided a cemented carbonitride comprising 75–97% by weight of a hard carbonitride component and 3–25, preferably 5–20, % by weight of a binder metal, the hard component comprising titanium as the main metal component, 10–40% preferably 20–30% by weight of one or both of tungsten and molybdenum and 3–25% preferably 5–15% by weight of tantalum and non metallic components of carbon and nitrogen the proportion of nitrogen being 5–40% preferably 15–35% by weight of the non metallic components and the binder metal being at least one element selected from the group consisting of iron, cobalt and nickel.

The alloy may further comprise up to 20% preferably 4–10% by weight of vanadium carbide and up to 1% preferably 0.1–0.4% by weight of aluminium.

The carbonitride component of the alloy is a two phase mixture comprising a titanium and tantalum rich phase poor in nitrogen and another phase which is rich in group VI metal components and rich in nitrogen. The two phase mixture forms a structure in which the titanium and tantalum rich phase is surrounded by the phase rich in group VI metals and forms the main interface with the binder alloy. Group IV metals include Cr, Mo and W.

In an alternate embodiment of the invention Ta is wholly or partly replaced by Nb. The cemented carbonitride with the characteristics of the above description has better resistance to wear and plastic deformation than the prior art cemented carbonitrides.

TiC-based cemented carbides with additions of other carbides such as WC and $Mo_2C$ to improve wetting properties generally form a two phase structure consisting of nearly unchanged TiC-cores and a rim rich in WC and $Mo_2C$ forming the main interface with the binder alloy.

However, the latter phase, being a solid solution, is prone to grain growth during sintering and consequently a rather large grain size obtained. This is detrimental to both strength and wear characteristics.

Additions of TiN drastically reduces the grain growth of TiC-based carbides mainly because the second phase, in contact with the binder, now consists of a carbonitride which is less prone to dissolution in the binder phase. TiN therefore has a favourable influence on strength and fracture toughness of the alloy. TiN also has a higher thermal conductivity than TiC and consequently the thermal conductivity of the alloy is increased leading to lower cutting edge temperatures and a more even temperature distribution for a given set of cutting data.

TiN therefore has a favourable influence on resistance to thermal cracking, temperature controlled wear mechanisms such as solution/diffusion wear and resistance against plastic deformation.

$Mo_2C$ and WC improve the wetting properties of the hard phase which improves the strength of the alloy. Molybdenum and tungsten also reduce the tendency for plastic deformation due to solid solution strengthening of the binder alloy.

VC and Al have shown to further improve the flank wear resistance when added to compositions of the invented alloy.

For further increase of the plastic deformation resistance it is essential also to investigate the role of the hard component. It consists essentially of central cores rich in titanium and carbon from the TiC-raw material surrounded by a second phase which is essentially a carbonitride rich in the other alloying elements. The TiC-cores thus occupy a rather large volume fraction of the hard component.

Plastic deformation of the tool at high temperatures will take place both in the binder phase and the hard phase. The hardness of TiC is rather low and much inferior to WC at high temperatures although the opposite is true for room temperature.

It is the object of this invention to improve the resistance to plastic deformation by improving the hot hardness of the TiC-cores.

It has now surprisingly been found that if Ta is present in addition to Ti in the cores of the grains according to the above description a considerable increase in plastic deformation resistance is obtained. Part of the Ta may be replaced by Nb.

The grain size is generally <5 μm with the major fraction of the grains <2 μm.

The invention is further illustrated by FIGS. 1, 2 and 3 which are SEM (Scanning Electron Microscope) photos of alloys using back scattered electrons mode at a magnification of 4000 times.

FIGS. 1, 2 and 3 show that the number of TiC based cores is drastically reduced when alloyed TiC-powder is used. Thê TiC based cores appear black and (Ti,Ta)C and (Ti,Ta,Nb)C based cores appear grey owing to higher average atomic number of the latter.

The invention also consists in a process of manufacture of a sintered alloy comprising carbides and nitrides of Ti, Ta and/or Nb which method comprises heating a first mixture of powders of TiC and (Ta,Nb)C and/or TaC under such conditions that the resultant first product contains a solid solution of (Ti,Ta)C or (Ti,-Ta,Nb)C, crushing said product to a powder, further mixing said powder with carbides and/or nitrides of metals selected from groups IV, V and VI preferably Ti, W, V, Mo and one or more of Co, Ni and Fe as binder in powder form whereafter pressing and sintering is performed as known in the art.

EXAMPLE 1

Solid solutions powders according to the invention were prepared using TiC, (Ta,Nb)C 80/20 and TaC powders which were first mechanically mixed and then heattreated at 2450° C. for 2.5 h in hydrogen. The resulting product was then crushed to a grain size <5 μm. X-ray diffraction analysis of the powders showed that the solid solutions were single phase with a lattice parameter of 4.33 Å for (Ti,Ta,Nb)C and 4.34 Å for (Ti,-Ta)C.

EXAMPLE 2

Tungsten carbide, titanium carbide, molybdenum carbide, tantalum-niobium carbide (80/20 weight-%), titanium-tantalum-niobium carbide (80/16/4 weight-%) (Example 1) and titanium-tantalum carbide (80/20 weight-%) (Example 1) and iron group metals serving as binders were used in the proportions listed in table 1 below to give samples with the same over all composition. The powders were mixed and ball milled using cemented carbide balls for 30 hours. The dried powder was then pressed and sintered in vacuum at 1410° C. for 90 minutes.

TABLE 1

| Composition w/o | Sample No 1 prior art | 2 | 3 |
|---|---|---|---|
| WC | 16.3 | → | → |
| $Mo_2C$ | 9.5 | → | → |
| TiC | 37.5 | 7.7 | 15.1 |
| (Ti, Ta)C (80/20) | — | — | 29.7 |
| (Ti, Ta, Nb)C (80/16/4) | — | 37.1 | — |
| (Ta, Nb)C (80/20) | 7.3 | — | — |
| TiN | 12.0 | → | → |
| VC | 4.0 | → | → |
| Co | 7.9 | → | → |
| Ni | 5.5 | → | → |

TABLE 1-continued

| Composition w/o | Sample No 1 prior art | 2 | 3 |
|---|---|---|---|
| HV3 | 1598 | 1615 | 1599 |

Figure 1:
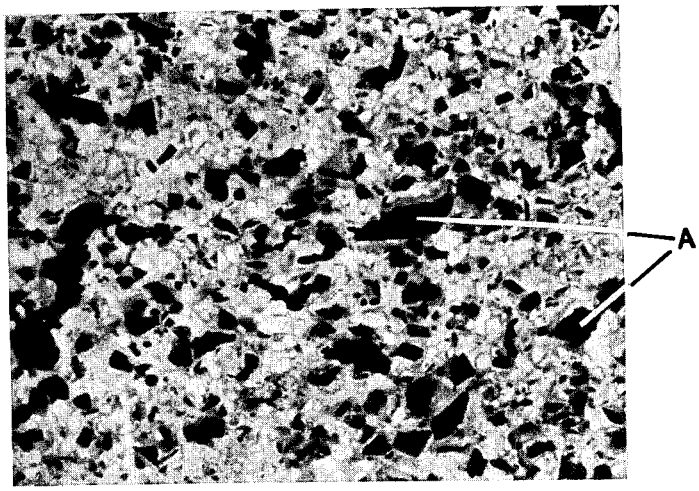
FIG. 1 shows an alloy according to prior art. A refers to TiC based cores.
Figure 2:
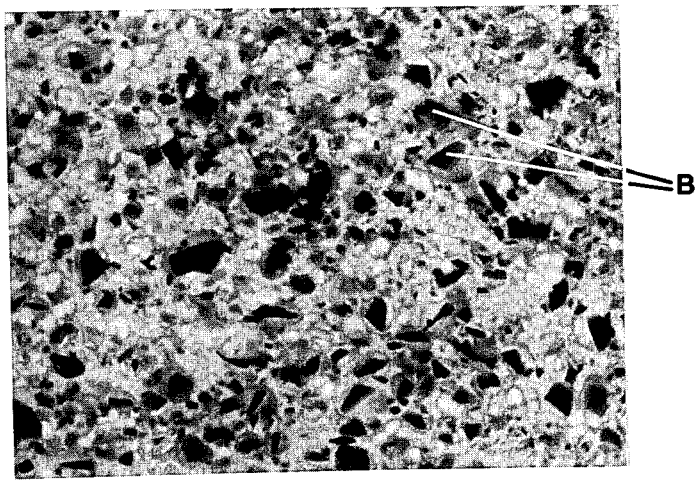
FIGS. 2 and 3 are alloys according to the invention where B is (Ti,Ta,Nb)C based cores and C is (Ti,Ta)C based cores.
Figure 3:
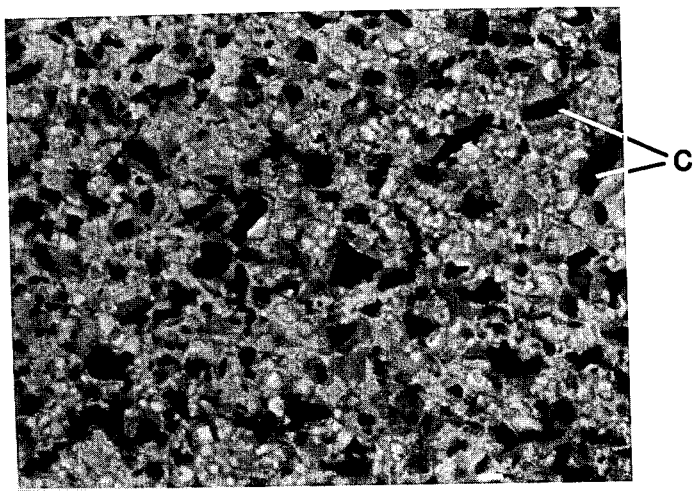

FIGS. 1-3 show the microstructure of samples 1-3 resp.

EXAMPLE 3

In substantially the same manner as in Example 2 tool tips were prepared with compositions according to table 2, using a sintering temperature of 1430° C.

TABLE 2

| Composition w/o | Sample No 4 prior art | 5 | 6 |
|---|---|---|---|
| WC | 16.2 | → | → |
| $Mo_2C$ | 9.5 | → | → |
| TiC | 30.3 | 2.0 | 9.0 |
| (Ti, Ta)C (80/20) | — | — | 28.4 |
| (Ti, Ta, Nb)C (80/16/4) | — | 35.4 | — |
| (Ta, Nb)C (80/20) | 7.1 | — | — |
| TiN | 15.9 | → | → |
| VC | 8.0 | → | → |
| Co | 7.8 | → | → |
| Ni | 5.2 | → | → |

EXAMPLE 4

The compositions of Example 2 were used to evaluate tool life when machining steel SS 2541 at 370 m $min^{-1}$ at a feed rate of 0.20 mm $rev^{-1}$ and depth of cut 1.5 mm. Insert type was TNMG 160408-QF. Tool life criterion was poor surface finish of the workpiece material caused by small fractures at the secondary cutting edge due to plastic deformation. The average tool life was evaluated in nine tests.

| Sample | Tool life, min |
|---|---|
| 1(prior art) | 6.0 |
| 2 | 10.6 |
| 3 | 13.5 |

EXAMPLE 5

Tools SNGN 120404 were made from compositions 4, 5 and 6 and used to machine SS 2541 at a cutting speed of 500 m $min^{-1}$ at a feed rate of 0.15 mm $rev^{-1}$ and depth of cut 0.5 mm. Tool life criterion was fracture caused by preceding plastic deformation of the main cutting edge. The average tool life was evaluated in seven different tests.

| Sample | Tool life, min |
|---|---|
| 4(prior art) | 3.9 |
| 5 | 7.3 |
| 6 | 10.0 |

As seen from Examples 4 and 5 compositions according to the invention, sample 2, 3, 5 and 6 have increased resistance against plastic deformation.

We claim:

1. Alloy for cutting tools comprising 75-97% by weight of a hard carbonitride component and 3-25% by weight of a binder metal, said hard carbonitride component comprising titanium as the main metallic component, 10–40% by weight of one or both of tungsten and molybdenum and 3–25% by weight of tantalum, the proportion of nitrogen in the hard carbonitride component being 5–40% by weight of the total carbon and nitrogen, the binder metal being at least one element selected from the group consisting of iron, cobalt and nickel, the carbonitride component of the alloy being a two phase mixture comprising a titanium and tantalum rich phase poor in nitrogen and another phase which is rich in group VI metal components and rich in nitrogen, the two phase mixture forming a structure in which the titanium and tantalum rich phase is surrounded by the phase rich in group VI metals and forms the main interface with the binder alloy.

2. Alloy according to claim 1 characterized in that it comprises up to 1% by weight of Al.

3. Alloy according to claim 2 comprising 0.1 to 0.4% by weight of Al.

4. Alloy according to claim 1 characterized in that the alloy includes other hard single phase components.

5. Alloy according to claim 4 wherein the other hard single phase component comprises WC.

6. Alloy according to claim 1 characterized in that it comprises up to 20% by weight of vanadium carbide.

7. Alloy according to claim 1 characterized in that Ta is partly or wholly replaced by Nb.

8. Alloy according to claim 1 wherein the tungsten and/or molybdenum content of the hard carbonitride component is from 20 to 30%.

9. Alloy according to claim 1 wherein the tantalum content of the hard carbonitride component is from 5 to 15%.

10. Alloy according to claim 1 wherein the proportion of nitrogen is from 15 to 35% of the total of carbon and nitrogen.

11. Alloy according to claim 1 comprising 4 to 10% by weight of vanadium carbide.

12. Alloy according to claim 1 wherein the hard carbonitride component contains at least 30% of tungsten and/or molybdenum at least 15% tantalum and the proportion of nitrogen is from 15to 35% of the total of carbon and nitrogen.

* * * * *